US011724145B1

(12) United States Patent
Stamper

(10) Patent No.: US 11,724,145 B1
(45) Date of Patent: Aug. 15, 2023

(54) COMBINATION TRAMPOLINE AND POLE DEVICE, A RETROFIT TRAMPOLINE AND POLE DEVICE FOR USE WITH A WATER STRUCTURE, AND AN ENTERTAINMENT SYSTEM

(71) Applicant: Milton Stamper, Hagerstown, MD (US)

(72) Inventor: Milton Stamper, Hagerstown, MD (US)

( * ) Notice: Subject to any disclaimer, the term of this patent is extended or adjusted under 35 U.S.C. 154(b) by 0 days.

(21) Appl. No.: 17/745,331

(22) Filed: May 16, 2022

(51) Int. Cl.
*A63B 5/11* (2006.01)
*A63B 9/00* (2006.01)

(52) U.S. Cl.
CPC ..... *A63B 5/11* (2013.01); *A63B 9/00* (2013.01); *A63B 2208/03* (2013.01); *A63B 2244/225* (2013.01)

(58) Field of Classification Search
CPC ..... A63B 5/11; A63B 9/00; A63B 2208/03; A63B 2244/22; A63B 71/0054; A63B 2209/023; A63B 71/022; A63B 2210/50; A63B 2208/12; A63B 2225/30; A63B 2209/02; A63B 71/023; A63B 2071/009; A63B 2209/026
See application file for complete search history.

(56) References Cited

U.S. PATENT DOCUMENTS 2,858,132 A * 10/1958 Sidlinger ..... A63B 5/11 482/28
3,339,925 A * 9/1967 Nissen ..... A63B 5/11 182/139
4,576,375 A * 3/1986 Roberts ..... A63B 5/11 472/129
4,730,826 A * 3/1988 Sudmeier ..... A63B 5/11 482/28
4,836,530 A * 6/1989 Stanley, Jr. ..... A63B 5/11 482/27
5,374,225 A * 12/1994 Wilkinson ..... A63B 23/03533 482/29
5,533,948 A * 7/1996 Wilkinson ..... A63B 22/0012 482/52
5,634,870 A * 6/1997 Wilkinson ..... A63B 23/1263 482/52
6,071,213 A * 6/2000 Raasch ..... E04H 4/0056 482/29
6,110,074 A 8/2000 Tacquet
6,135,922 A * 10/2000 Nissen ..... A63B 5/11 482/28
D561,274 S 2/2008 Turner
7,338,411 B2 * 3/2008 Blacker ..... A63B 21/1681 482/904
D631,518 S * 1/2011 Coote ..... D21/679
8,137,243 B2 * 3/2012 Coote ..... A63B 9/00 482/33

(Continued)

*Primary Examiner* — Garrett K Atkinson
(74) *Attorney, Agent, or Firm* — Garcia-Zamor Intellectual Property Law, LLC; Ruy Garcia-Zamor

(57) ABSTRACT

A combination trampoline and pole device that may be used for exercise, adult entertainment, and/or recreational purposes. A retrofit trampoline and pole device that may be use with a water structure for exercise, adult entertainment, and/or recreational purposes. An entertainment system that may comprise a trampoline and a pole that may be used for exercise, adult entertainment, and/or recreational purposes.

19 Claims, 11 Drawing Sheets

(56) References Cited

U.S. PATENT DOCUMENTS

D792,934 S * 7/2017 Gaut ..... D21/797
9,707,426 B2 * 7/2017 Tsai ..... A63B 5/11
D884,103 S * 5/2020 Hammer ..... D21/797
10,758,763 B1 * 9/2020 Chen ..... A63G 9/00
D933,154 S * 10/2021 Chen ..... D21/797
D944,338 S * 2/2022 Li ..... D21/672
2002/0137598 A1 * 9/2002 Publicover ..... A63B 5/11 482/27
2005/0108818 A1 5/2005 Cordray
2006/0135321 A1 * 6/2006 Chen ..... A63B 5/11 482/8
2008/0282461 A1 * 11/2008 Sneed ..... E04H 4/08 4/498
2012/0289379 A1 * 11/2012 Stokes ..... A63B 5/11 482/27
2013/0210590 A1 * 8/2013 Publicover ..... A63B 67/002 482/110
2014/0171228 A1 * 6/2014 Holland ..... A63B 69/0097 473/434
2015/0040959 A1 * 2/2015 Andon ..... E04H 15/02 135/161
2015/0080186 A1 * 3/2015 Carlin ..... A63B 5/11 482/27
2015/0190666 A1 * 7/2015 Chen ..... A63B 5/11 482/29
2017/0080270 A1 * 3/2017 Andon ..... A63B 5/11
2017/0216648 A1 * 8/2017 Male ..... A63B 71/023
2017/0216702 A1 * 8/2017 Valle ..... A63B 71/0054
2017/0312644 A1 * 11/2017 Meir ..... A63B 5/11
2017/0340939 A1 * 11/2017 Chen ..... A63B 67/10
2018/0280750 A1 * 10/2018 Fischer ..... A63B 21/4035
2018/0290000 A1 * 10/2018 Chen ..... A63B 71/022
2018/0369629 A1 * 12/2018 Publicover ..... A63B 5/11
2020/0222738 A1 * 7/2020 Kuo ..... A63B 5/11
2020/0238152 A1 * 7/2020 Hagel ..... A63B 71/022
2020/0338379 A1 * 10/2020 Chen ..... A63B 5/11
2022/0409942 A1 * 12/2022 Chen ..... A63B 71/0622

* cited by examiner

COMBINATION TRAMPOLINE AND POLE DEVICE, A RETROFIT TRAMPOLINE AND POLE DEVICE FOR USE WITH A WATER STRUCTURE, AND AN ENTERTAINMENT SYSTEM

BACKGROUND

The preferred embodiments of the present invention relate generally to exercise and entertainment. More specifically, the preferred embodiment of the present invention relates to a combination trampoline and pole device.

Typically, there have been limited options for the use of poles or trampolines for exercise and entertainment. This has reduced the number of possible activities that can be enjoyably used with such devices.

Therefore, it may be advantageous to provide a combination trampoline and pole device, a retrofit trampoline and pole device for use with a water structure, and/or an entertainment system which may, but does not necessarily, provide: an improved system or device for providing entertainment; an improved system or device for mounting onto a water structure; a retrofit system or device for use with a water structure or otherwise; an improved system or device for exercising; an easy to use system or device for providing entertainment; an easy to use system or device for mounting onto a water structure; an easy to use system or device for exercising; an improved system or device for providing pole performance and trampoline acrobatics; and/or an improved system or device for combining pole performance and trampoline acrobatics with a water structure.

SUMMARY

Briefly speaking, one embodiment of the present invention is directed to a combination trampoline and pole device.

In a separate embodiment, the present invention is directed to a retrofit trampoline and pole device for use with a water structure.

In a separate embodiment, the present invention is directed to an entertainment system with a pole and a jumping mat.

In a separate aspect, the present invention is directed to a combination trampoline and pole device. The combination may comprise a trampoline and a pole. The trampoline may further comprise a support structure having an open top side. The trampoline may also comprise an elastic mat. The elastic mat may be configured to at least partially cover the open top side of the support structure. The trampoline may also comprise a plurality of elastic members configured to connect the elastic mat to the support structure. The pole may be configured to extend through a hole in the elastic mat such that the pole is substantially perpendicular to the elastic mat when the elastic mat is unstretched.

In a separate aspect, the present invention is directed to a combination trampoline and pole device. The combination may comprise a trampoline and a pole. The trampoline may further comprise a support structure having an open top side. The support structure and the pole may extend from a supporting surface. The open top side of the support structure may be at a first height above the supporting surface.

In a separate aspect, the present invention is directed to a combination trampoline and pole device. The combination may comprise a trampoline and a pole. The trampoline may also comprise an elastic mat. The open top side of the support structure may be at a first height above the supporting surface. When the elastic mat and the elastic members may be fully stretched under the weight of a user, the elastic mat may form a maximum concave shape. The maximum concave shape may have a second height which is less than the first height.

In a separate aspect, the present invention is directed to a combination trampoline and pole device. The combination may comprise a trampoline and a pole. The trampoline may also comprise an elastic mat. The open top side of the support structure may further extend to a first height above the supporting surface. When the elastic mat and the elastic members may be fully stretched under the weight of a user, the pole may remain centered in the hole.

In a separate aspect, the present invention is directed to a combination trampoline and pole device. The combination may comprise a trampoline and a pole. The trampoline may also comprise an elastic mat. The open top side of the support structure may further extend to a first height above the supporting surface. After the elastic mat and the elastic members may be stretched under the weight of a user, the elastic mat and elastic members may provide a returning force to propel and assist the user in climbing the pole.

In a separate aspect, the present invention is directed to a combination trampoline and pole device. The combination may comprise a trampoline and a pole. The trampoline may further comprise a support structure having an open top side. The support structure and the pole may extend from a supporting surface. The open top side of the support structure may be at a first height above the supporting surface. The support structure, the trampoline, and the pole may be detachably affixed to the supporting surface.

In a separate aspect, the present invention is directed to a combination trampoline and pole device. The combination may comprise a trampoline and a pole. The trampoline may also comprise an elastic mat. When the elastic mat and the elastic members may be fully stretched under the weight of a user, the pole may remain centered in the hole. The hole may be configured with a grommet. The grommet may have a diameter large enough to accommodate the pole. The grommet may reduce wear and friction on the hole and the pole when the trampoline is in use.

In a separate aspect, the present invention is directed to a combination trampoline and pole device. The combination may comprise a trampoline and a pole. The trampoline may further comprise a support structure having an open top side. The support structure may further comprise a basin. The basin may be located between the elastic mat and the supporting surface. The basin may be capable of containing liquid.

In an alternative preferred embodiment, the present invention is directed to a retrofit trampoline and pole device. The retrofit trampoline and pole may be used with a water structure having an open top. The retrofit device may comprise an elastic mat configured to at least partially cover the open top of the water structure. The retrofit device may also comprise a plurality of elastic members configured to stretch the elastic mat over the water structure. The retrofit device may further comprise an attachment mechanism for connecting the plurality of elastic members to a top edge of the water structure. The retrofit device may comprise a pole configured to extend through a hole in the elastic mat. The pole may be substantially perpendicular to the elastic mat when the elastic mat is unstretched.

In an alternative preferred embodiment, the present invention is directed to a retrofit trampoline and pole device. The retrofit trampoline and pole may be used with a water structure having an open top. The retrofit device may comprise an elastic mat configured to at least partially cover the open top of the water structure. When the elastic mat and the elastic members may be fully stretched under the weight of a user, the elastic mat may form a maximum concave shape. The maximum concave shape may be under a surface of water in the water structure and above a bottom of the water structure.

In an alternative preferred embodiment, the present invention is directed to a retrofit trampoline and pole device. The retrofit trampoline and pole may be used with a water structure having an open top. The retrofit device may comprise an elastic mat configured to at least partially cover the open top of the water structure. The elastic mat may be porous or otherwise may allow the water to penetrate the elastic mat so that the user may get wet when the elastic mat is stretched below the surface of the water.

In an alternative preferred embodiment, the present invention is directed to a retrofit trampoline and pole device. The retrofit trampoline and pole may be used with a water structure having an open top. The retrofit device may comprise a pole configured to extend through a hole in the elastic mat. A lower end of the pole may be detachably connected the bottom of the water structure.

In an alternative preferred embodiment, the present invention is directed to a retrofit trampoline and pole device. The retrofit trampoline and pole may be used with a water structure having an open top. The trampoline may comprise an elastic mat. The elastic mat may be set at a ground level when the top edge of the water structure may be set at the ground level and a remaining portion of the water structure may be beneath the ground level.

In an alternative preferred embodiment, the present invention is directed to an entertainment system. The entertainment system may be configured for use by a person. The entertainment system may be positionable on and supportable along a generally planar surface. The entertainment system may comprise a pole configured to extend upwardly from the generally planar surface. The pole may have a functional base positioned along the generally planar surface. The entertainment system may also comprise a jumping mat positioned on the generally planar surface and may extend outwardly from the functional base of the pole. The jumping mat may be configured to provide a trampoline effect. The pole may be fixable in position to allow the person to interact therewith and lift off of the jumping mat. By partially disengaging from the pole, the person may then bounce on and/or depress the jumping mat.

In an alternative preferred embodiment, the present invention is directed to an entertainment system. The entertainment system may be configured for use by a person. The entertainment system may be positionable on and supportable along a generally planar surface. The entertainment system may comprise a pole configured to extend upwardly from the generally planar surface. The entertainment system may further comprise a stability structure. The stability structure may have a stabilizer configured to accommodate an upper end of the pole.

In an alternative preferred embodiment, the present invention is directed to an entertainment system. The entertainment system may further comprise a stability structure. The stability structure may comprise a mirrored ball positioned on the stabilizer and configured to rotate. The stability structure may also comprise a plurality of lights positioned at predetermined points on the stability structure. The plurality of lights may comprise a plurality of colors. Some of plurality of lights may shine generally downwardly toward the person. Some of the plurality of lights may shine toward the mirrored ball.

In an alternative preferred embodiment, the present invention is directed to an entertainment system. The entertainment system may further comprise a jumping mat. The jumping mat may be detachably positioned over a water structure When the person may depress the mat, the person can get wet from the water contained in the water structure.

In an alternative preferred embodiment, the present invention is directed to an entertainment system. The entertainment system may further comprise a jumping mat and a pole. The jumping mat may comprise a central hole. The central hole may be configured to accommodate the pole extending therethrough.

In an alternative preferred embodiment, the present invention is directed to an entertainment system. The entertainment system may further comprise a stability structure. The stability structure may also comprise a plurality of lights positioned at predetermined points on the stability structure. The plurality of lights may comprise a plurality of colors. The plurality of lights may be configured to move, change colors, and flash in response to the person bouncing on the mat and music playing during use.

BRIEF DESCRIPTION OF THE DRAWINGS

The foregoing summary, as well as the following detailed description of the preferred embodiments of the present invention will be better understood when read in conjunction with the appended drawings. For the purpose of illustrating the invention, there are shown in the drawings embodiments which are presently preferred. At least one of the embodiments of the present invention is accurately represented by this application's drawings which are relied on to illustrate such embodiment(s) to scale and the drawings are relied on to illustrate the relative size, proportions, and positioning of the individual components of the present invention accurately relative to each other and relative to the overall embodiment(s). Those of ordinary skill in the art will appreciate from this disclosure that the present invention is not limited to the scaled drawings and that the illustrated proportions, scale, and relative positioning can be varied without departing from the scope of the present invention as set forth in the broadest descriptions set forth in any portion of the originally filed specification and/or drawings. It is understood, however, that the invention is not limited to the precise arrangements and instrumentalities shown. In the drawings.

Figure 1:
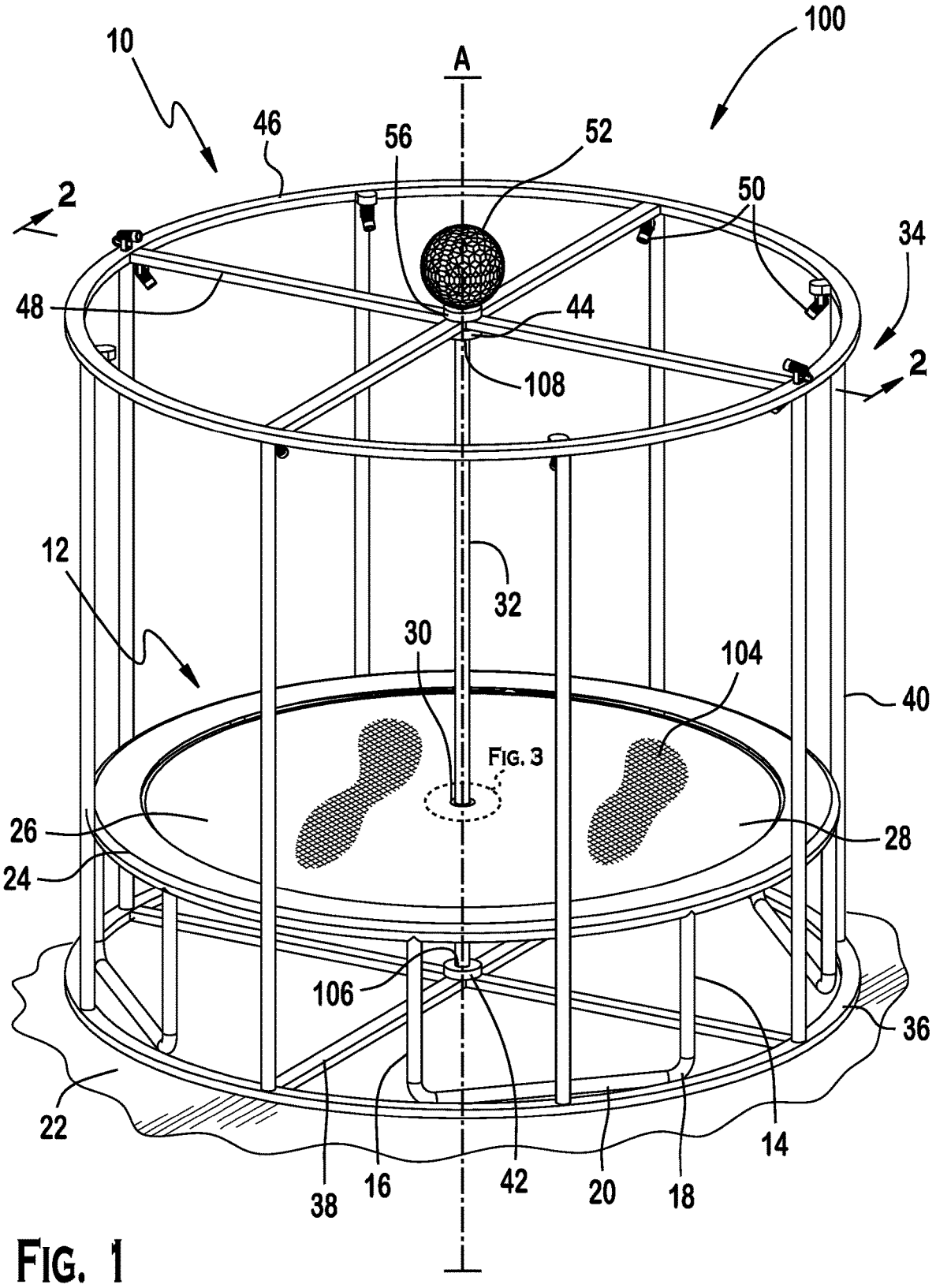
FIG. 1 is a perspective view of a combination trampoline and pole device 10 and/or an entertainment system 100. The device/system 10, 100 comprises a trampoline 12 and a pole 32. The trampoline 12 comprises a support/stability structure 14. The support/stability structure 14 further comprises a trampoline support 16 extending vertically from the outer rim 24. The trampoline support 16 connects to a joint 18 that turns approximately 90° and connects to a surface contacting portion 20. The trampoline 12 is positioned on a supporting surface 22. The trampoline 12 further comprises an elastic, or jumping, mat 26 stretched between an open top side 28 of the trampoline 12 and radially inside the outer rim 24. The pole 32 extends through a hole 30 in the elastic, or jumping, mat 26. A pole axis A can be seen extending in the axial direction along the radial center of the pole 32.

The pole support structure 34 comprises a base rim 36 designed to be supported on the supporting surface 22. The base rim 36 is reinforced by the base supports 38. A pole lower end 106 is supported by a lower pole holder 42 positioned on the base supports 38. A plurality of support beams 40 extend upward from the base rim 36 to a top rim 46. The top rim 46 is reinforced by the top supports 48. A pole upper end 108 is supported by a stabilizer 44 positioned on the top supports 48. A plurality of lights 50 are also positioned at predetermined locations along the top rim 46 and the top supports 48. A mirrored ball 52 is configured to sit on a ball holder 56 positioned on the top supports 48 opposite the stabilizer 44. This figure also shows a plurality of elastic members 54 stretching the elastic mat 26 along a generally planar surface 102. The generally planar surface 102 is positioned at a first height $H_1$ above the supporting surface 22. A maximum concave shape 98 of the elastic mat 26 is also shown extending to a second height H2 below the generally planar surface 102. A functional base B of the pole 32 is seen at either the level of the supporting surface 22 or the generally planar surface 102.

Figure 3:
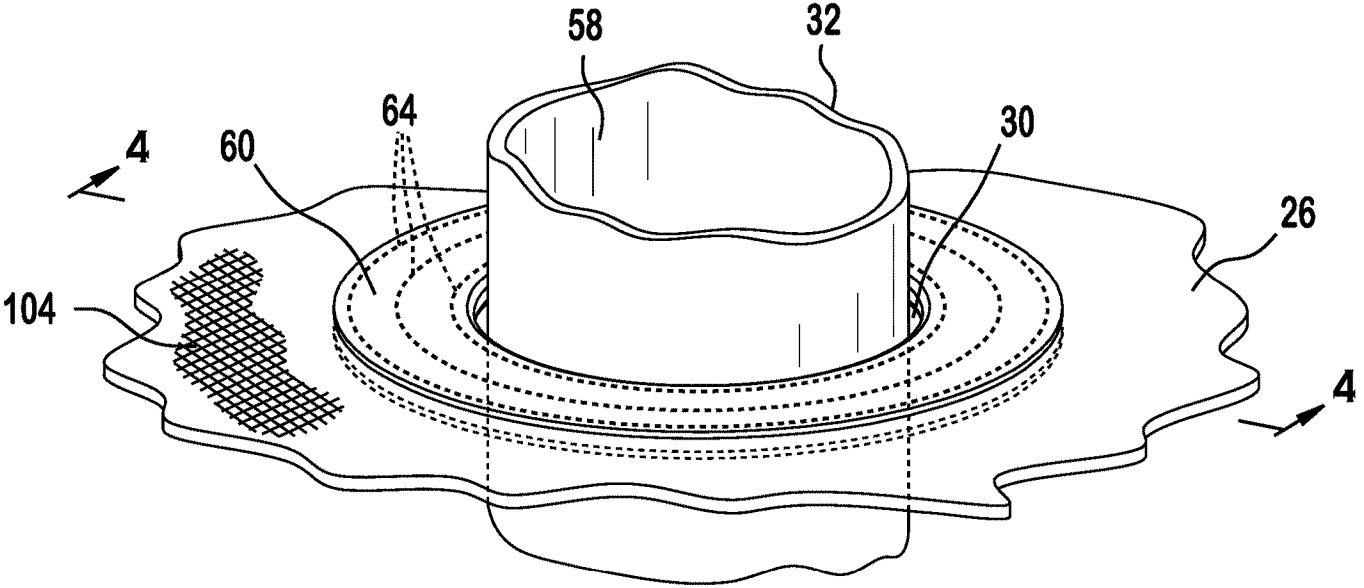

FIG. 3 is a partially broken away, perspective view of the hole 30 in the elastic, or jumping, mat 26 of the device/system 10, 100 of FIG. 1. A broken away portion of the pole 32 is seen extending through the hole 30. A grommet 60 is seen positioned around the hole 30 in the elastic mat 26. The grommet 60 is configured to contact the pole 32. The pole 32 is shown in this figure as having a hollow center 58.

Figure 4:
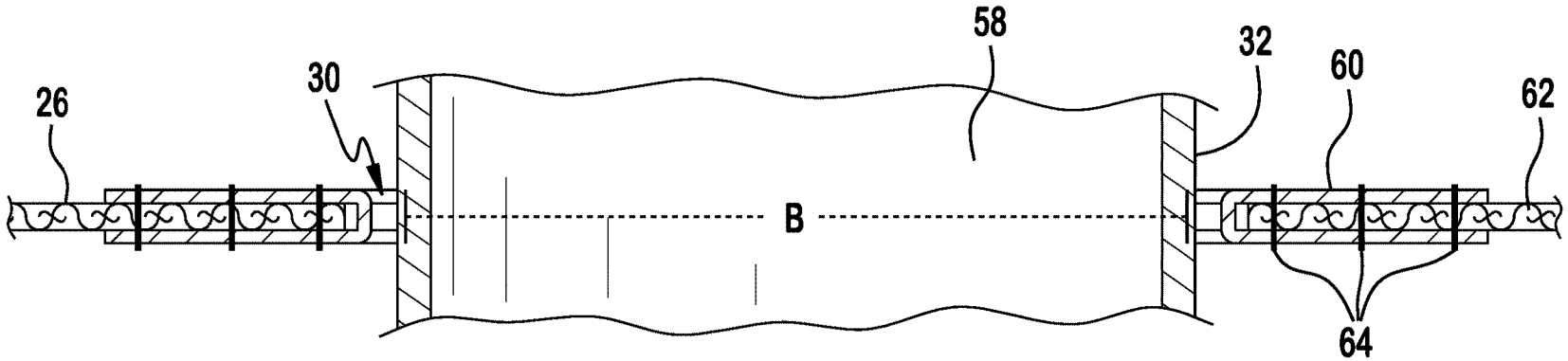

FIG. 4 is a cross-sectional view of the hole 30 in the elastic, or jumping, mat 26 of the device/system 10, 100 of FIG. 1 as taken along the lines 4-4 of FIG. 3. This figure shows the grommet 60 being attached to the elastic mat 26 by a plurality of attachment mechanisms 64. The elastic material 62 of the elastic mat 26 is also shown. The functional base B when taken along the generally planar surface 102 can also be seen.

Figure 5:
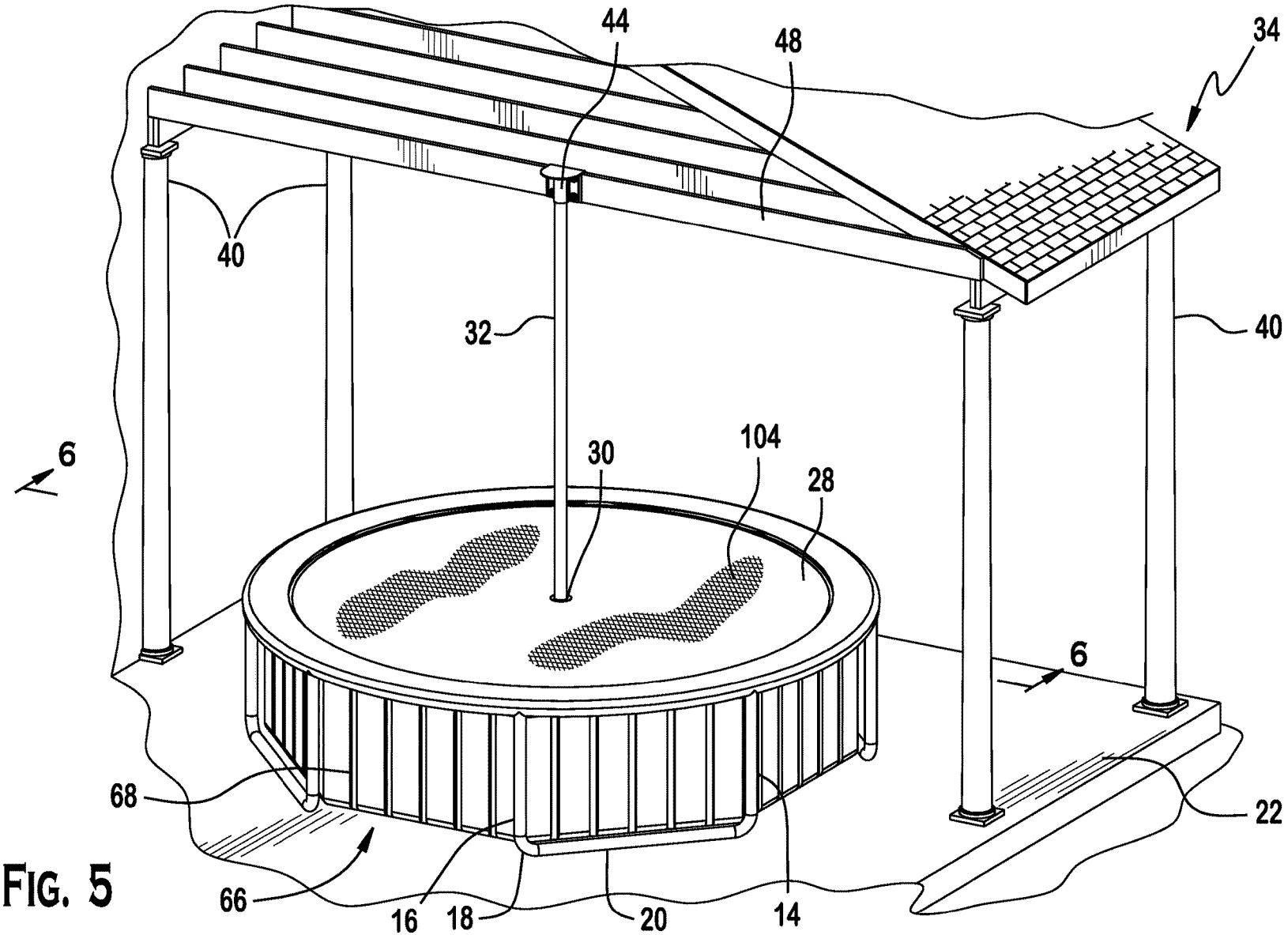

FIG. 5 is a perspective view of the alternative trampoline and pole retrofit device 10 for use with a water structure 66. The water structure 66 is shown comprising a tub 66. The tub 66 comprises a tub support structure 68. The tub support structure 68 has a smaller diameter or area so that the support/stability structure 14 of the trampoline 12 can fit around it. Here, the pole support structure 34 comprises a building. The building is positioned on the supporting surface 22. The pole 32 extends up to a stabilizer 44 connected to the building.

Figure 6:
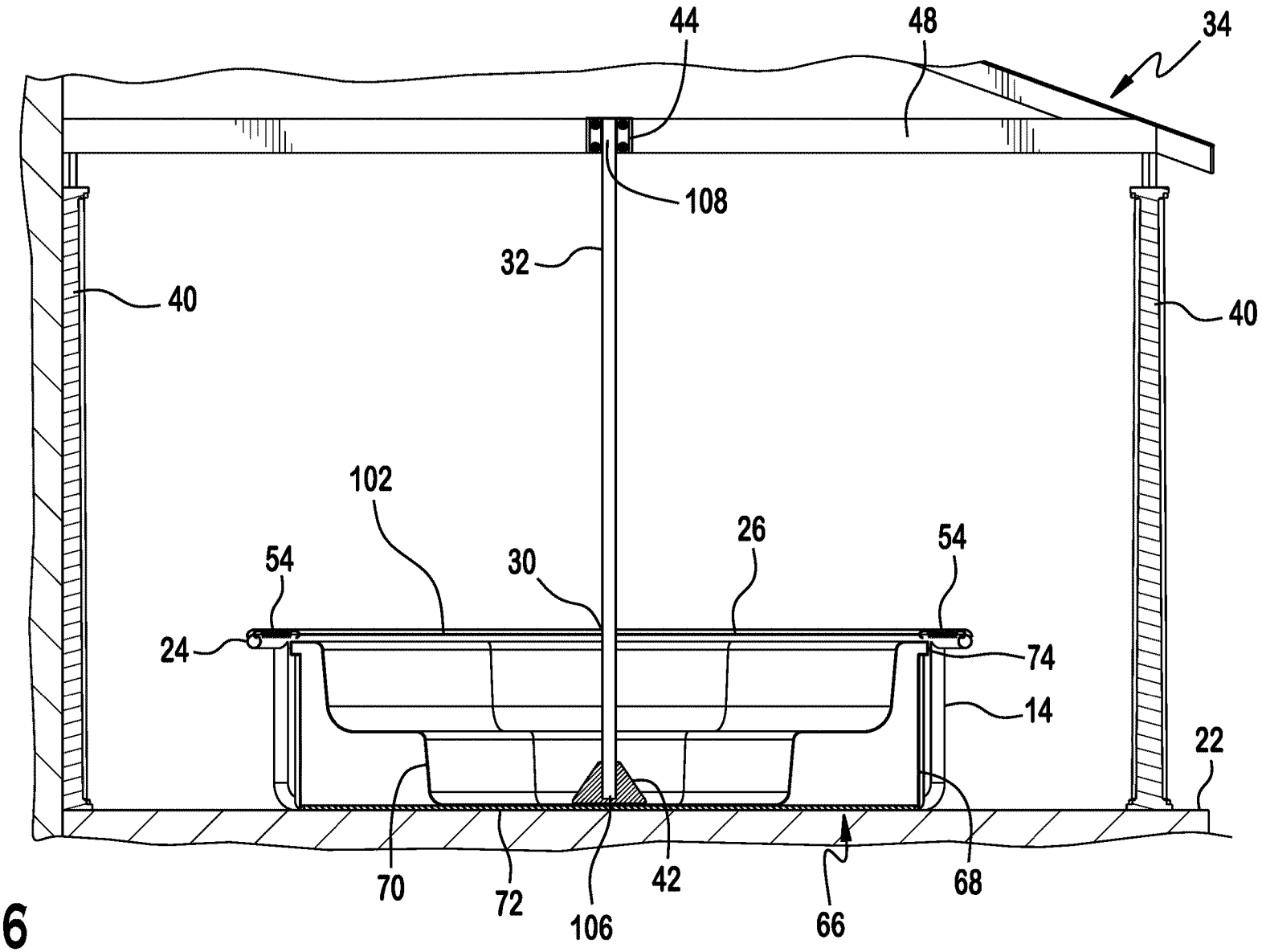

FIG. 6 is a cross-sectional view of the retrofit device 10 of FIG. 5 as taken along the lines 6-6 of FIG. 5. This figure illustrates the interior of the tub 66. The tub 66 further comprises a basin 70 configured to hold a liquid/water therein. The tub 66 further comprises a bottom 72. The bottom 72 of the tub 66 is positioned on the supporting surface 22. A rim, or top edge, 74 of the tub 66 can also be seen extending along the generally planar surface 102. The tub 66 also has an open top 76 configured to be covered by the elastic mat 26. A lower pole holder 42 is positioned on the bottom 72 of the tub 66.

Figure 7:
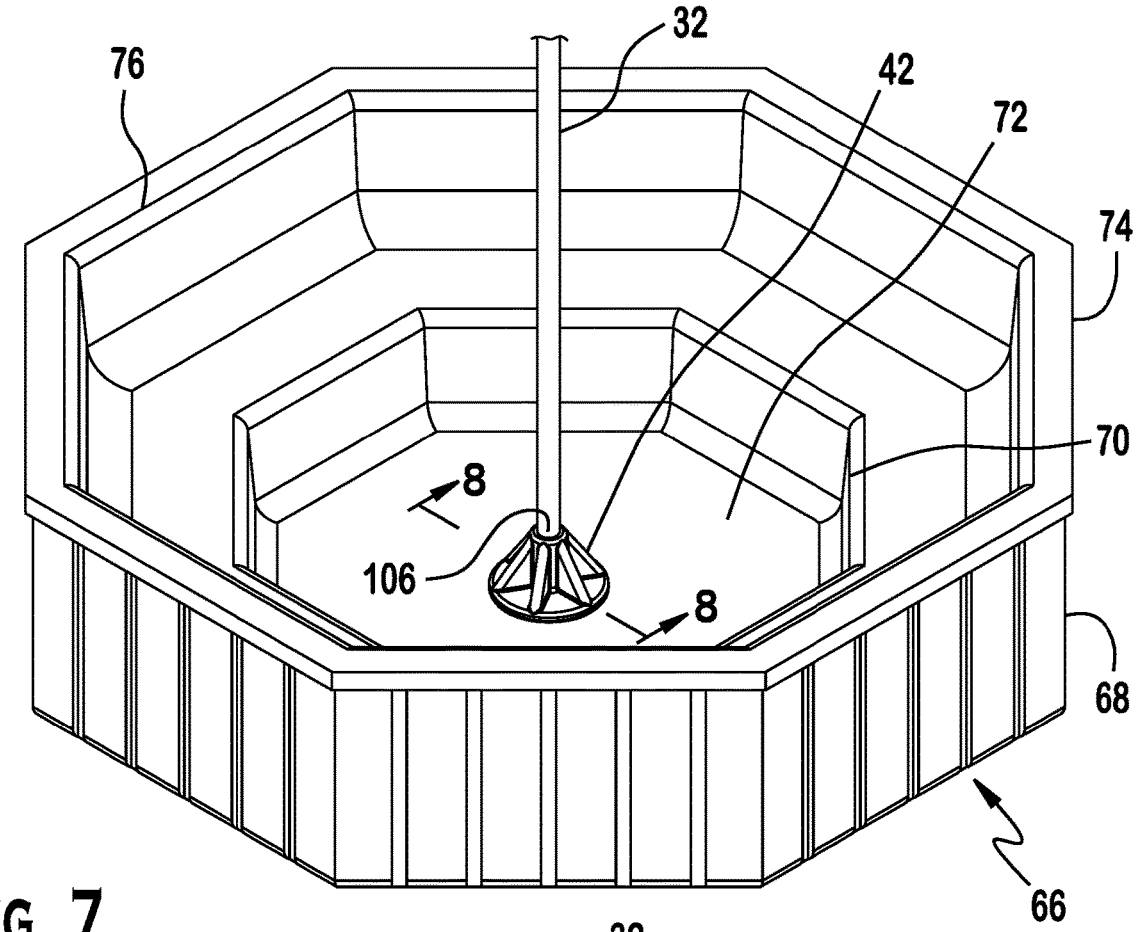

FIG. 7 is a front, partial, perspective view of the retrofit device 10 of FIG. 5. The pole 32 can be seen clearly extending into the lower pole holder 42 positioned on the bottom 72 of the tub 66. This figure also more clearly illustrates the shape of the basin 70 within the tub 66.

Figure 8:
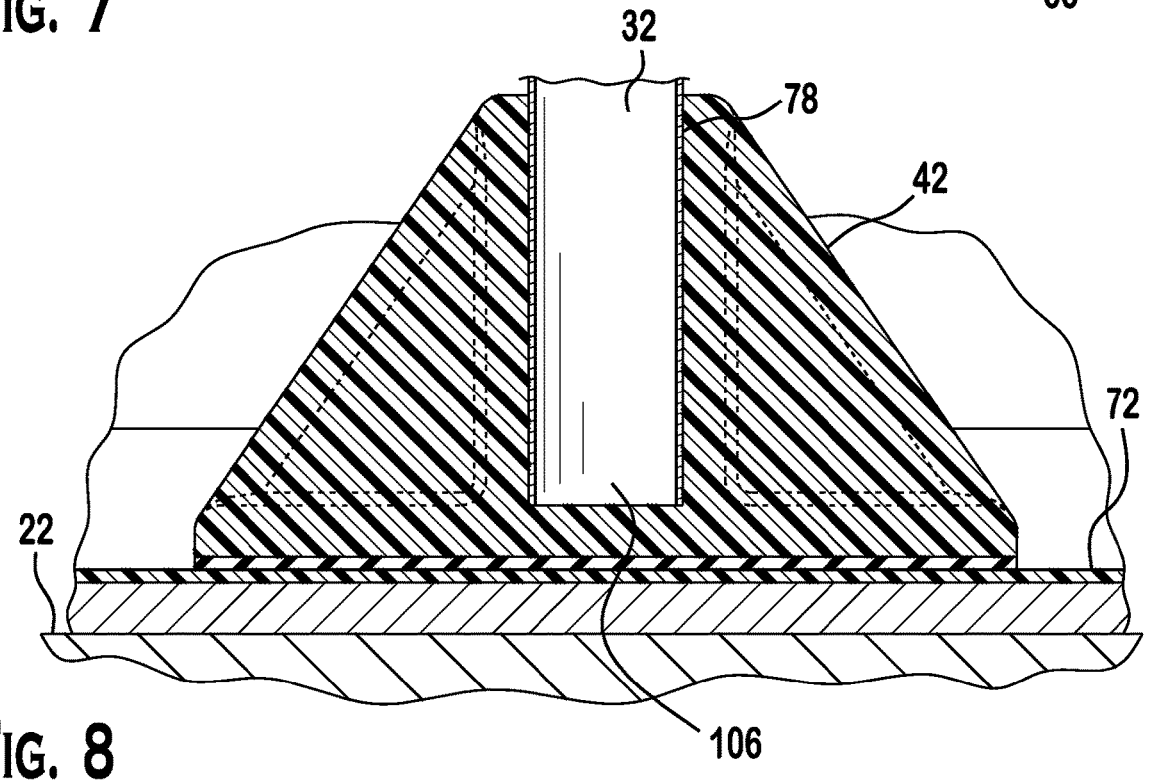

FIG. 8 a cross-sectional view of lower pole holder 42 of the retrofit device 10 of FIG. 5 as taken along the lines 8-8 of FIG. 7. Here, the pole 32 is seen extending into a lower sleeve 78 contained within the lower pole holder 42. The lower pole holder 42 is configured to provide stability and support to the pole 32.

Figure 9:
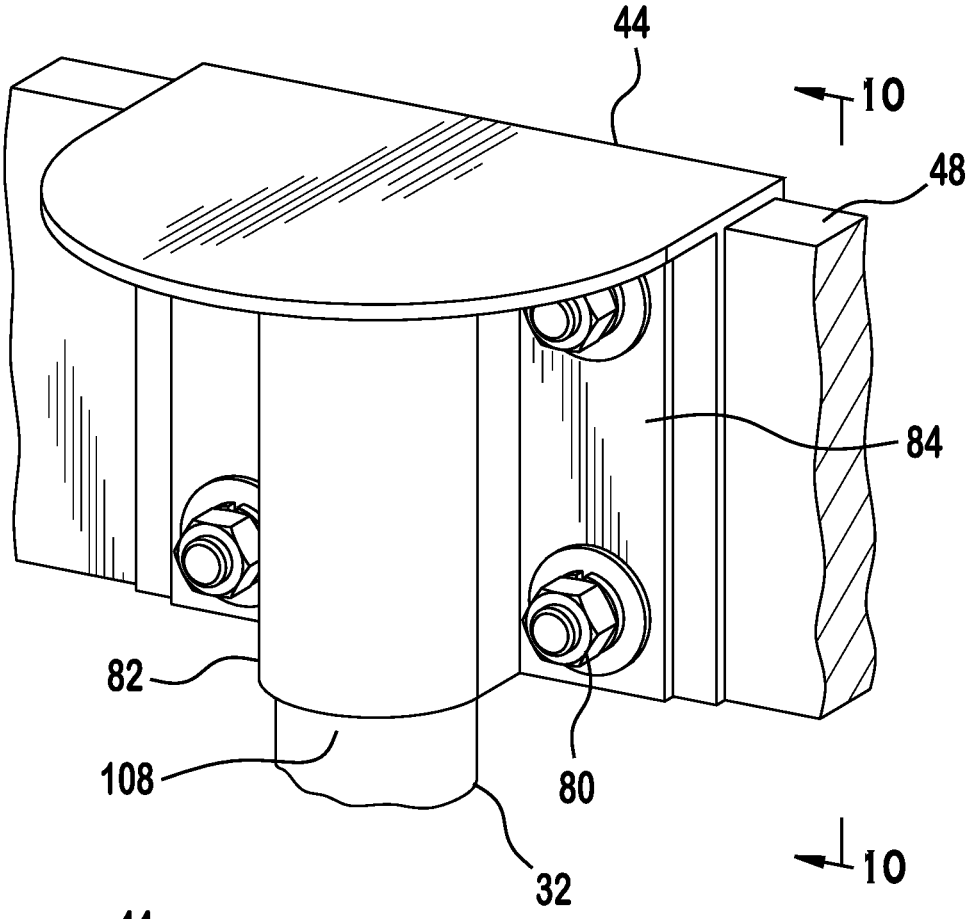

FIG. 9 is a perspective view of the stabilizer 44 of the retrofit device 10 of FIG. 5. The stabilizer 44 is shown connected to the top supports 48. The stabilizer comprises a plurality of bolts 80 for connecting the attachment plate 84 of the stabilizer 44 to the top supports 48. The pole 32 is seen extending into the upper sleeve 82 of the stabilizer 44.

Figure 10:
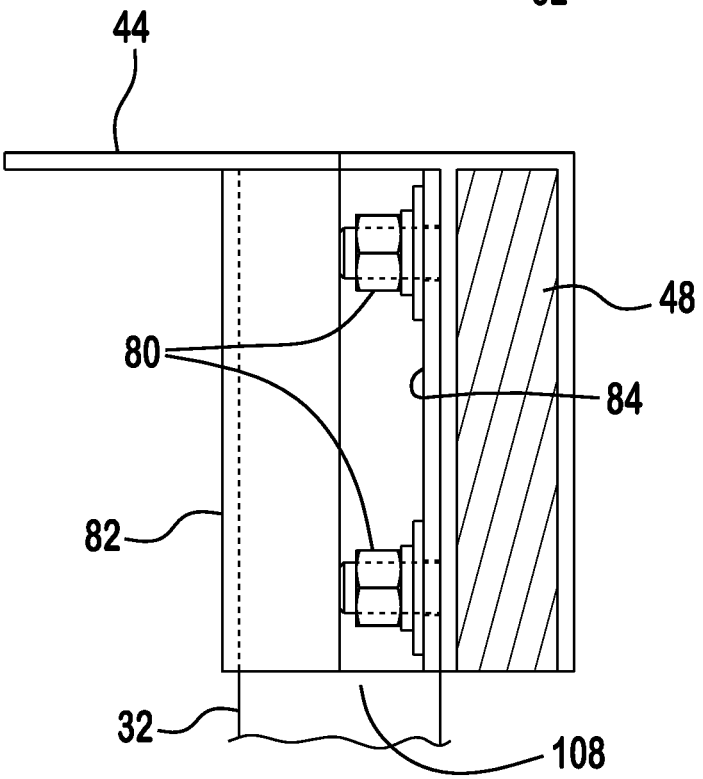

FIG. 10 is a cross-sectional view of the stabilizer 44 of the retrofit device 10 of FIG. 5 as taken along the lines 10-10 of FIG. 9. In this view, the bolts 80 can be seen extending through the attachment plate 84 into the top supports 48. The pole 32 can be more clearly seen extending into the upper sleeve 82 of the stabilizer 44.

Figure 11:
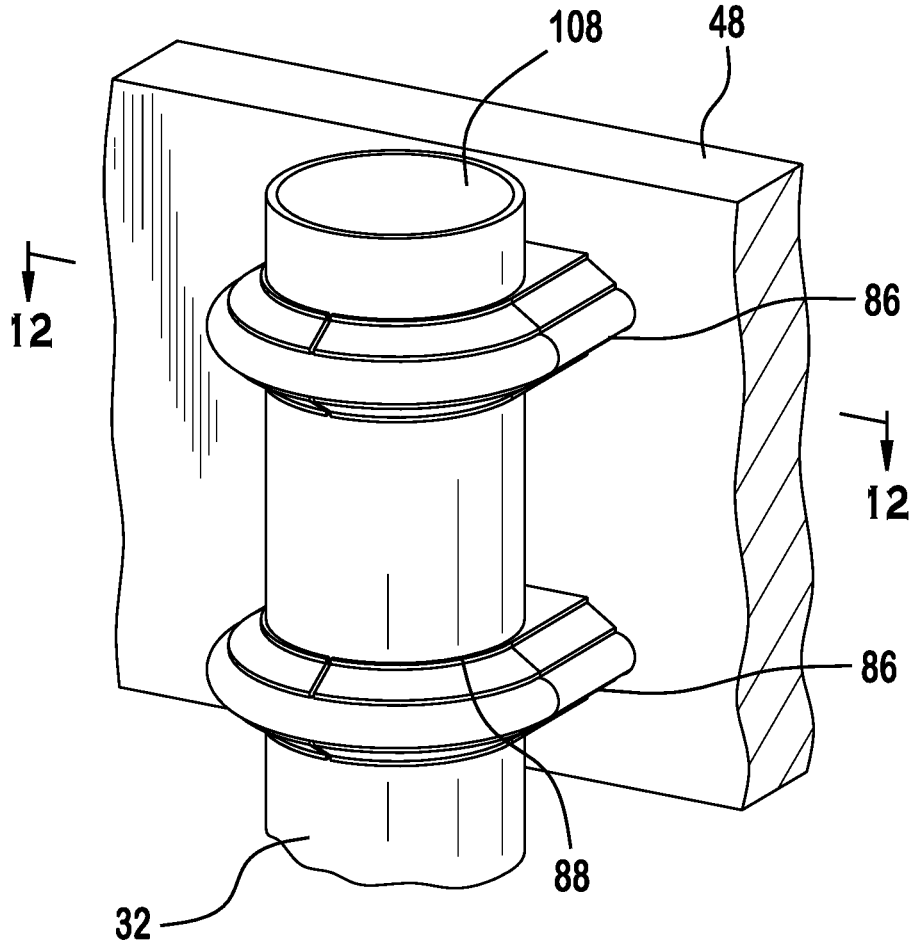
Figure 13:
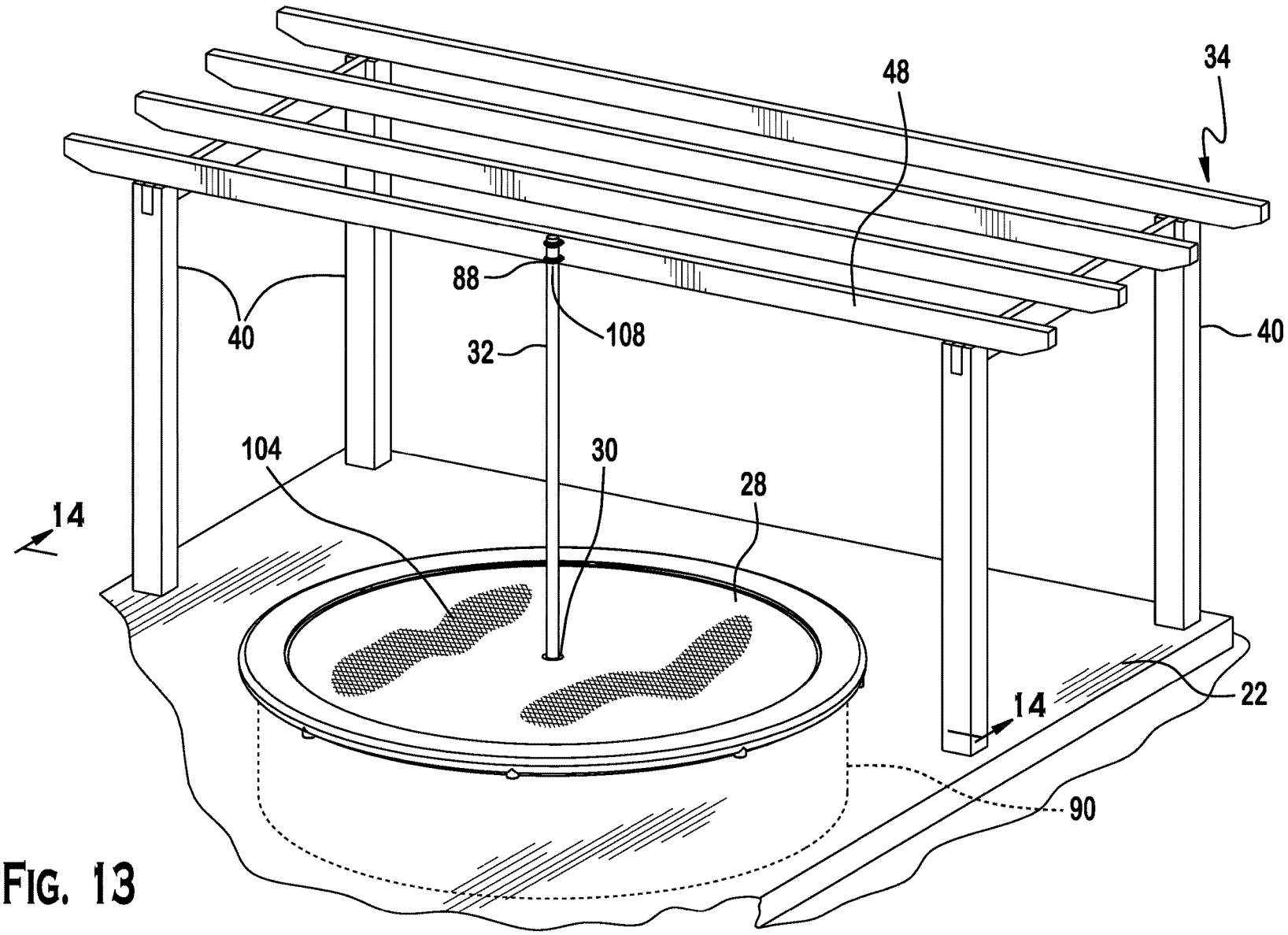

FIG. 11 is a perspective view of the stabilizer 44 of the retrofit device 10 of FIG. 13. Here, the stabilizer 44 comprises a U-shaped stabilizer 86. The U-shaped stabilizer 86 has bolts 80 on the end of the U for attaching to the top supports 48. The U-shaped stabilizer 86 forms a stabilizer hole 88 for the pole 32 to extend therethrough.

Figure 12:
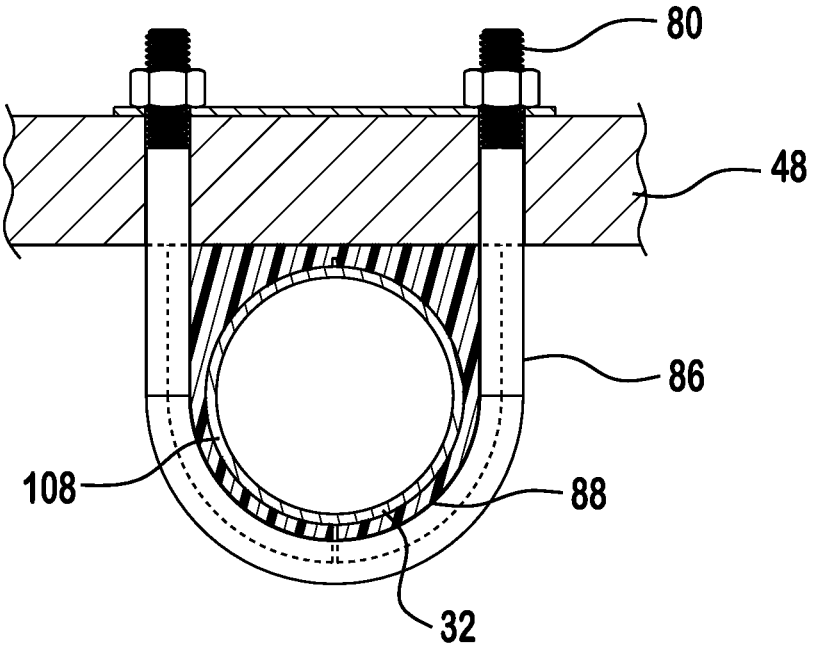

FIG. 12 is a cross-sectional view of the stabilizer 44 of the retrofit device 10 of FIG. 13 as taken along the lines 12-12 of FIG. 11. This figure illustrates the pole 32 extending through the stabilizer hole 88 of the U-shaped stabilizer 86.

FIG. 13 is a perspective view of the alternative trampoline and pole retrofit device 10 for use with a water structure 66. This figure shows the water structure 66 comprising an inground tub 90. The inground tub 90 has a rim 74 positioned on the supporting surface 22. In this case, the supporting surface 22 is at a ground-level. The elastic mat 26 is shown to be made of a porous material 104. The stabilizer 44 in this embodiment is shown to be the U-shaped stabilizer 86.

Figure 14:
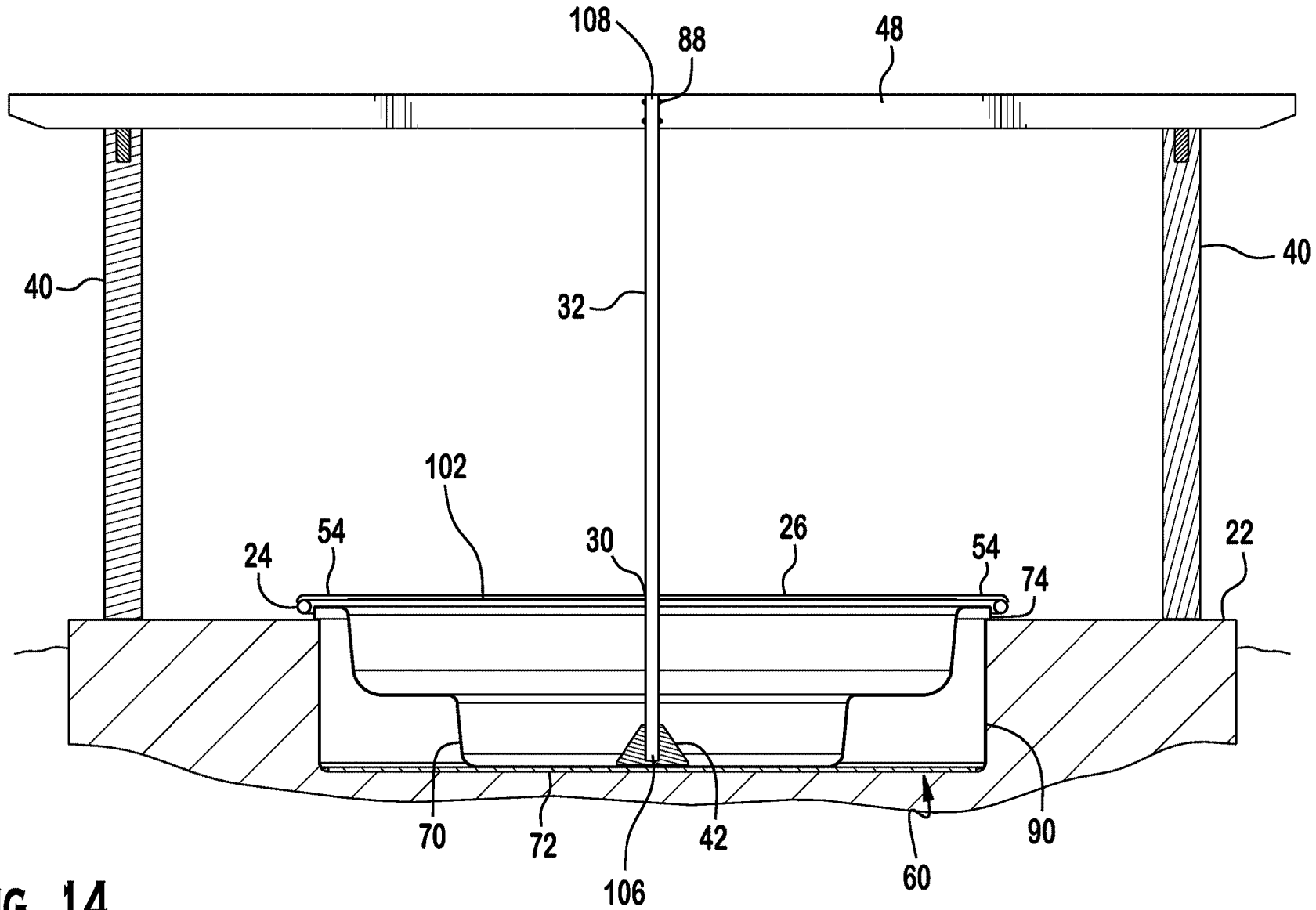

FIG. 14 is a cross-sectional view of the retrofit device 10 of FIG. 13 as taken along the lines 14-14 of FIG. 13. This figure illustrates the outer rim 24 of the elastic mat 26 being positioned on the supporting surface 22. The supporting surface 22 is at a ground-level. The outer rim 24 may be detachably affixed onto the rim 74 of the tub 66. In this case, the basin 70 of the tub 66 is set below the ground level.

Figure 15:
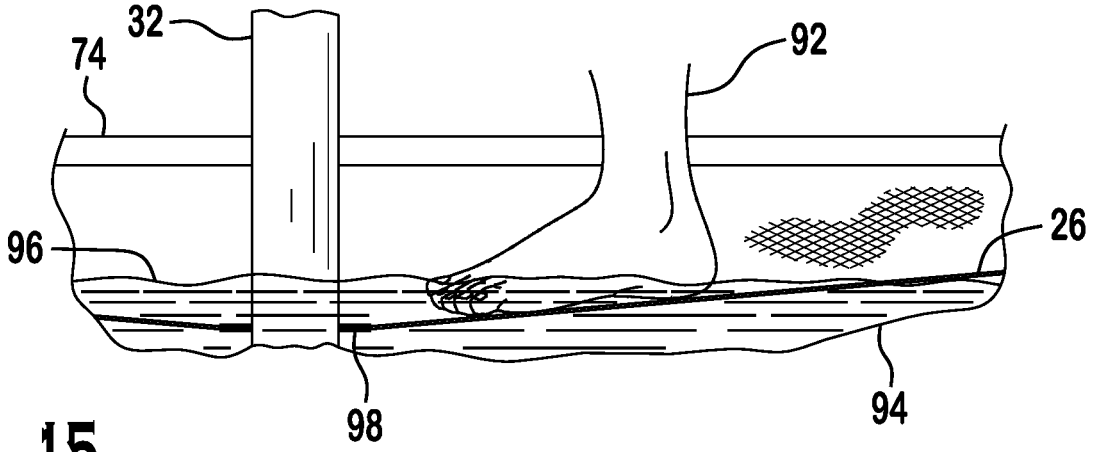

FIG. 15 is a partial perspective view of the alternative trampoline and pole retrofit device 10 for use with a water structure 66. Here, a person/user 92 may be seen depressing the elastic mat 26 to the maximum concave shape 98 below a water surface 96 of the water 94. The hole 30 of the elastic mat 26 may be seen still surrounding the pole 32 even though the elastic mat 26 has been depressed by the user 92. This also shows how the user 92 may get wet when the elastic mat 26 is depressed.

Figure 16:
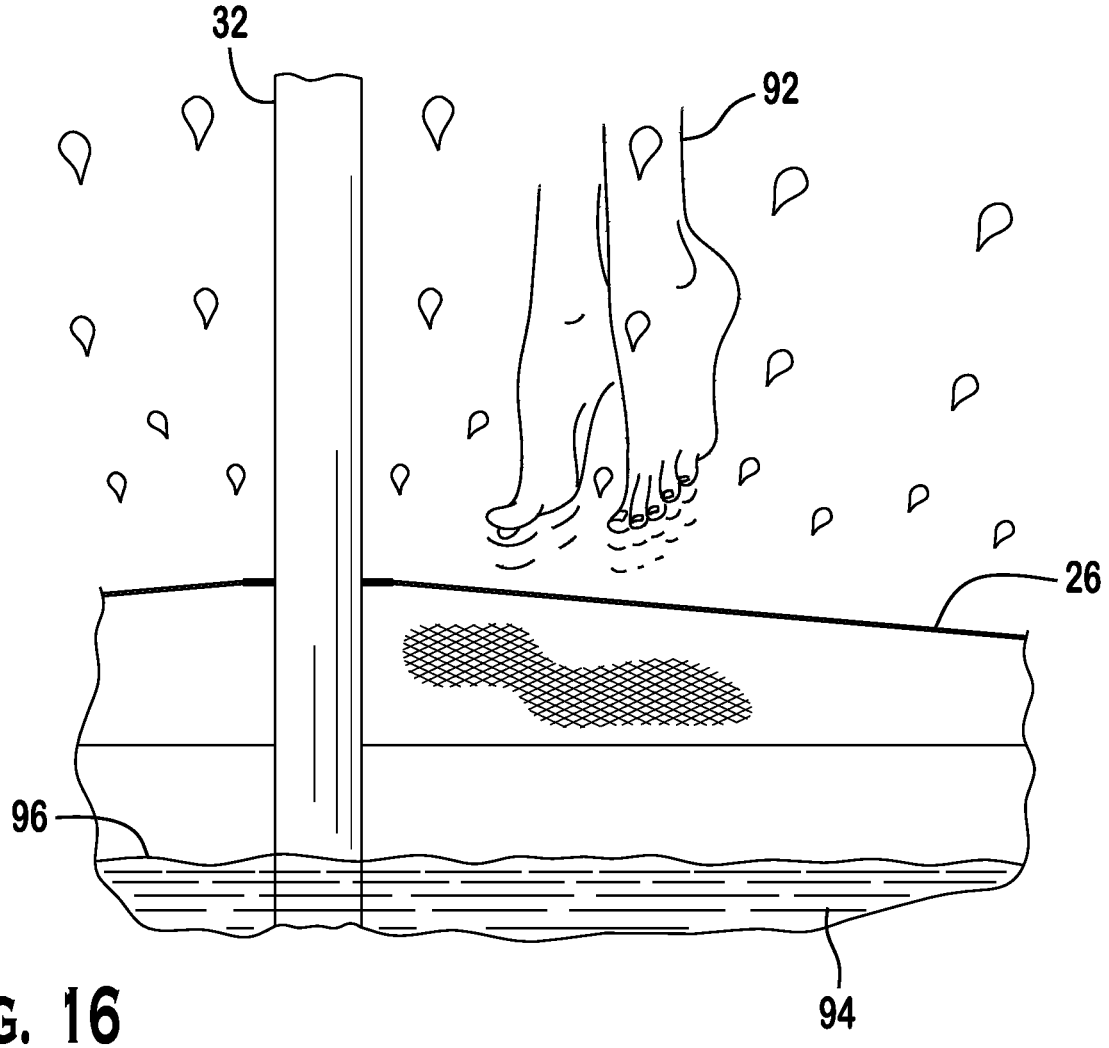

FIG. 16 is a partial perspective view of the alternative trampoline and pole retrofit device 10 for use with a water structure 66. Here, the elastic mat 26 is demonstrating the returning force F which propels the user 92 upwards so that the user 92 can reach a higher point on the pole 32. This is a demonstration of the trampoline effect. This also shows how the user 92 may get wet when the elastic mat 26 flings water droplets into the air around the user 92.

DETAILED DESCRIPTION OF THE PREFERRED EMBODIMENT

Certain terminology is used in the following description for convenience only and is not limiting. The words "right," "left," "up," and "down" designate the directions as they would be understood by a person facing drawings unless specified otherwise. At least one of the embodiments of the present invention is accurately represented by this application's drawings which are relied on to illustrate such embodiment(s) to scale and the drawings are relied on to illustrate the relative size, proportions, and positioning of the individual components of the present invention accurately relative to each other and relative to the overall embodiment(s). Those of ordinary skill in the art will appreciate from this disclosure that the present invention is not limited to the scaled drawings and that the illustrated proportions, scale, and relative positioning can be varied without departing from the scope of the present invention as set forth in the broadest descriptions set forth in any portion of the originally filed specification and/or drawings. The words "outer" and "inner" refer to directions away from and toward, respectively, the geometric center of the specified element, or, if no part is specified, the geometric center of trampoline and pole device 10 or entertainment system 100. The terms "downward" and "upward refers to directions above (or away from) and below (or toward) the referenced surface of the elastic mat 26, the supporting surface 22, or the device 10, 100 during operation, respectively, unless specified otherwise. The terms "forward" and "front" refer to a direction in front of the referenced structure which faces the front of the device or forward from the device, and the term "rear" and back refers to a direction behind the reference structure which faces the back of the device or rearward from the device. The terms "axial" and "radial" refer to directions along the pole 32, respectively. The terms "touching," "abutting," "against," and "contacting" when used in connection with two surfaces is defined as meaning "being positioned anywhere between actual touching of two surfaces to being in facing orientation and within a range of zero (0) to one (1) inches (or zero (0) to two point five four (2.54) centimeters) apart or less, which includes actual contact." Those of ordinary skill in the art will appreciate from this disclosure that skill in the art will appreciate from this disclosure that when a range is provided such as (for example) an angle/distance/number/weight/volume/spacing being between one (1 of the appropriate unit) and ten (10 of the appropriate units) that specific support is provided by the specification to identify any number within the range as being disclosed for use with a preferred embodiment. For example, the recitation of a percentage of copper between one percent (1%) and twenty percent (20%) provides specific support for a preferred embodiment having two point three percent (2.3%) copper even if not separately listed herein and thus provides support for claiming a preferred embodiment having two point three percent (2.3%) copper. By way of an additional example, a recitation in the claims and/or in portions of the specification of at least twenty (20°) degrees, provides specific literal support for any angle greater than twenty (20°) degrees, such as twenty-three (23°) degrees, thirty (30°) degrees, thirty-three-point five (33.5°) degrees, forty-five (45°) degrees, fifty-two (52°) degrees, or the like. The language "at least one of 'A', 'B', and 'C'," as used in the claims and in corresponding portions of the specification, means "any group having at least one 'A'; or any group having at least one 'B'; or any group having at least one 'C'; -- and does require that a group have at least one of each of 'A', 'B', and 'C'." More specifically, the language 'at least two/three of the following list' (the list itemizing items '1', '2', '3', '4', etc.), as used in the claims, means at least two/three total items selected from the list and does not mean two/three of each item in the list. The term "interior" (or inside, within, etc.), as used in the claims and corresponding portions of the specification means the area proximate to the center of the invention. The term "exterior" (our outside, etc.) similarly defines the area not in proximity to the center of the invention. Additionally, the words "a" and "one" are defined as including one or more of the referenced items unless specifically stated otherwise. The terminology includes the words specifically mentioned above, derivatives thereof, and words of similar import.

Referring generally to FIGS. 1-16, wherein like numerals indicate like elements throughout, preferred embodiments of a combination trampoline and pole device 10 and/or an entertainment system 100 are disclosed. More specifically, FIG. 1 illustrates multiple preferred embodiments of the device/system 10, 100. This device/system 10, 100 greatly improves the ease with which an exercise pole may be used may be providing additional lift assistance for a user and additional safety for dismounting the exercise pole. It is preferred, but not required, that the device/system 10, 100 is transportable, easy to set up, and useable with a variety of accessories.

Figure 2:
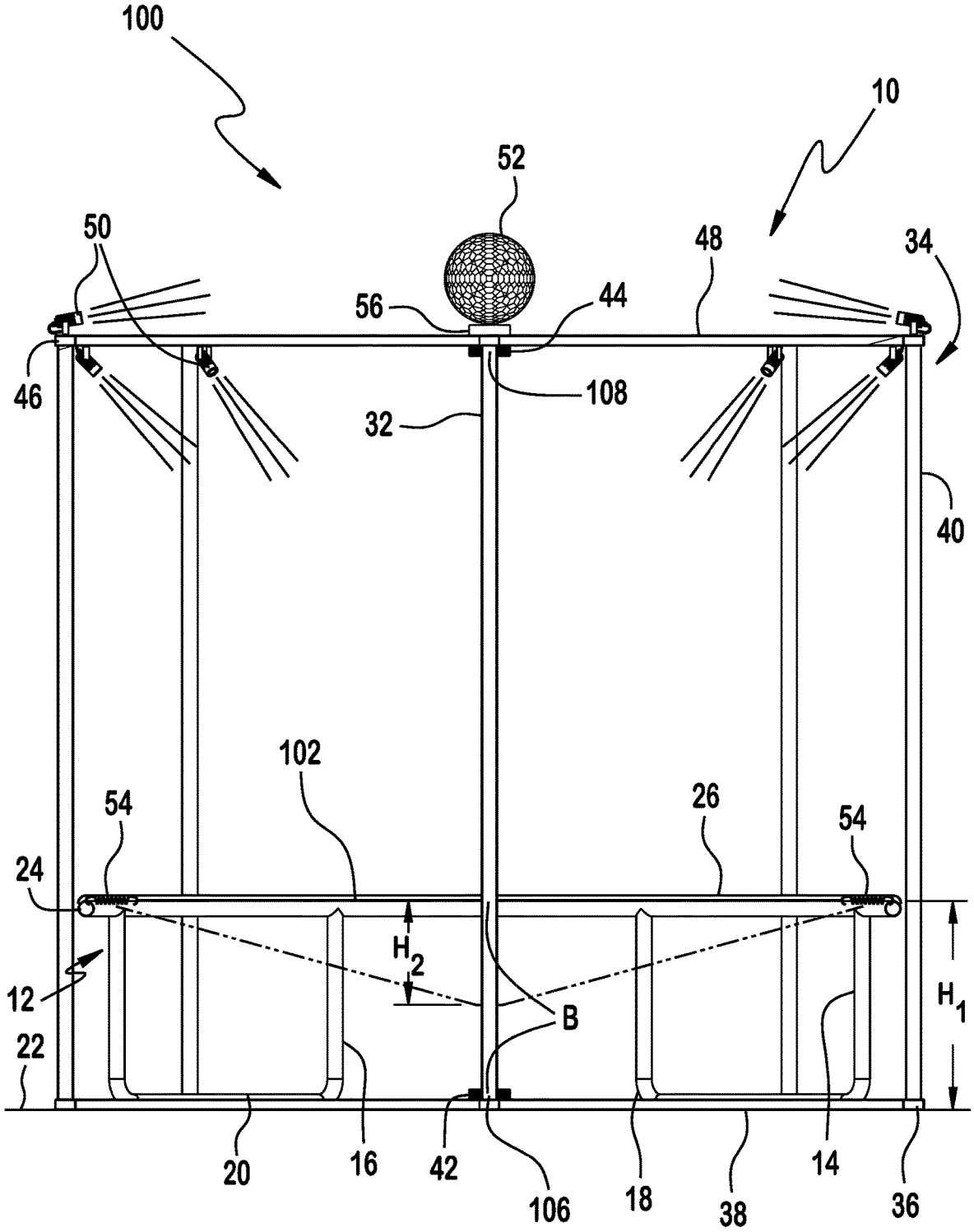
FIG. 2 is a cross-sectional view of the device/system 10, 100 of FIG. 1 as taken along the lines 2-2 of FIG. 1. This figure shows the pole 32 contained within the pole support structure 34. The pole support structure 34 is wider in diameter than the outer rim of 24 of the trampoline 12 so that the pole support structure 34 can surround the trampoline 12.

Referring generally to FIGS. 1 and 2, the combination trampoline and pole device 10 and/or entertainment system 100 can be seen. The device/system 10, 100 may comprise a trampoline 12 and a pole 32. The trampoline 12 may further comprise a support/stability structure 14 which supports the outer rim 24 of the trampoline 12. The support/stability structure 14 may have trampoline supports 16 extending downwardly from the outer rim 24 which connect to a surface contacting portion 20 via a plurality of joints 18. It is preferred, but not necessary, that the joints 18 are rounded such that the trampoline support 16 and the surface contacting portion 20 form a 90° angle. The surface contacting portion 20 may sit on a supporting surface 22. One of ordinary skill in the art will appreciate from this disclosure that other suitable angles may be formed by the joints 18 between the trampoline support 16 and the surface contacting portion 20 without departing from the scope of this invention. One of ordinary skill in the art would appreciate from this disclosure the outer rim 24 of the trampoline 12 may be circular as shown in the figures, but may also be any other suitable shape such as a square, a rectangle, an octagon, or the like, without departing from the scope of the present invention.

Referring still generally to FIGS. 1 and 2, an elastic, or jumping, mat 26 may be seen stretched over an open top side 28 of the trampoline 12. As seen more clearly in FIG. 2, the elastic mat 26 may be connected to the outer rim 24 via a plurality of elastic members 54. The combination of the elastic mat 26 and the elastic members 54 allow for bouncing on the trampoline 12. The elastic mat 26 may also comprise a hole 30. It is preferred, but not necessary, that the hole 30 is centered on the elastic mat 26. The pole 32 may extend through the hole 30 in the elastic mat 26. A pole axis A may run an axial direction along the center of the pole 32.

Referring specifically to FIG. 1, the device/system 10, 100 may comprise a pole support structure 34. The pole support structure 34 may comprise a base rim 36 resting on a supporting surface 22. One of ordinary skill in the art would appreciate from this disclosure that the base rim 36 of the pole support structure 34 may be circular as shown in the figures, but may also be any other suitable shape such as a square, a rectangle, an octagon, or the like, without departing from the scope of the present invention. The only size requirement of the pole support structure 34 is that it may be large enough to accommodate the trampoline 12 contained therein. The base rim 36 is reinforced by base supports 38 contained therein. The base supports 38 may be similar to spokes on a wheel if the base rim 36 is circular. There may be support beams 40 that extend vertically from the base rim 36. The support beams 40 may be similar in length to the pole 32. The support beams 40 may connect to a top rim 46 of the pole support structure 34. The pole support structure 34 may be cage-like. The top rim 46 may be supported by top supports 48 in a similar way that base supports 38 support the base rim 36.

Referring still to FIG. 1, a plurality of lights 50 may be seen disposed along the top rim 46 and the top supports 48. Some of the plurality of lights 50 may be configured to shine generally downward toward a user of the device/system 10, 100. Some other of the plurality of lights 50 may be configured to shine at a mirrored ball 52 supported by a ball holder 56 positioned on the top supports 48. The plurality of lights 50 may be colored and may be configured to rotate and change angles. The mirrored ball 52 may also be configured to rotate on the ball holder 56. "Configured to shine generally downward" preferably means that the angle between a horizontal plane lying along the top rim 46 and the direction the plurality of lights 50 are shining is no greater than ninety degrees (90°). More preferably, "configured to shine generally downward" means that the angle between a horizontal plane lying along the top rim 46 and the direction the plurality of lights 50 are shining is between ten degrees (10°) and eighty degrees (80°). More preferably still, "configured to shine generally downward" means that the angle between a horizontal plane lying along the top rim 46 and the direction the plurality of lights 50 are shining is between thirty degrees (30°) and sixty degrees (60°). Most preferably, "configured to shine generally downward" means that the angle between a horizontal plane lying along the top rim 46 and the direction the plurality of lights 50 are shining is fifty degrees (45°). One of ordinary skill in the art would appreciate from this disclosure that the plurality of lights 50 may be configured to rotate, flash, and/or change colors in response to a user bouncing on the mat and/or music playing without departing from the scope of the present invention.

Referring now specifically to FIG. 2, the device/system 10, 100 may be seen in greater detail. The pole 32 may be supported at a pole lower end 106 by a lower pole holder 42 positioned on the base supports 38. The pole 32 may be supported at a pole upper end 108 by a stabilizer 44 positioned on the top supports 48. The elastic mat 26 may lie along a generally planar surface 102. The elastic mat 26 may be connected to the outer rim 24 of the trampoline 12 by the elastic members 54. "A generally planar surface 102" means that the surface of the elastic mat 26 is flat when the trampoline 12 is not in use. The pole 32 may have a functional base B. The functional base B may be defined as being at the pole lower end 106 or at the axial point of the pole 32 lying in the generally planar surface 102. The pole 32 may optionally not extend through the hole 30 in the elastic mat 26 and instead stop at the generally planar surface 102. In this variation, the functional base B may only be the pole lower end 106. The generally planar surface 102 and the plastic mat 26 may lie at a first height $H_1$ above the supporting surface 22. The maximum concave shape 98 of the elastic mat 26 when fully stretched is also shown at a second height Hz below the generally planar surface 102. The first height $H_1$ is strictly greater than the second height Hz. The maximum concave shape 98 is shown in the phantom lines indicated in the figure. One of ordinary skill in the art will appreciate from this disclosure that the elastic members 54 may be springs, bungee style cords, or the like, without departing from the scope of the present invention.

One of ordinary skill in the art would appreciate from this disclosure that a plurality of additional poles may also extend through the elastic mat 26 without departing from the scope of the present invention.

Referring still to FIG. 2, the pole 32 is configured to extend through the hole 30 substantially perpendicular to the generally planar surface 102. "Substantially perpendicular" preferably means that the angle between the generally planar surface 102 and the pole 32 is no less than forty-five degrees (45°). More preferably, "substantially perpendicular" means that the angle between the generally planar surface 102 and the pole 32 is no less than sixty degrees (600°). More preferably still, "substantially perpendicular" means that the angle between the generally planar surface 102 and the pole 32 is no less than eighty degrees (80°). Most preferably, "substantially perpendicular" means that the angle between the generally planar surface 102 and the pole 32 is ninety degrees (90°).

Now referring generally to FIGS. 3 and 4, the hole 30 in the elastic, or jumping, mat 26 may be seen in greater detail. The pole 32 is seen extending through the hole 30. The pole 32, shown in FIG. 3, may have a hollow center 58. One of ordinary skill in the art would appreciate from this disclosure that the pole 32 may also be made of a solid material without departing from the scope of the present invention. The hole 30 may also be reinforced by a grommet 60. The grommet 60 may be made of a thicker fabric material, metal, or any other suitable material for reducing wear and friction on both the pole 32 and the hole 30. The grommet 60 may be connected to the elastic mat 26 by plurality of attachment mechanisms 64. The attachment mechanism 64 may comprise pins, stitching, or the like, without departing from the scope of the present invention. A functional base B of the pole 32 may also be seen in FIG. 4 lying along the generally planar surface 102. The elastic mat 26 can also be seen as being made of an elastic material 62.

One of ordinary skill in the art would appreciate from this disclosure that the device/system 10, 100 may also be permanently built into a stage, runway, performance space, dance studio, recreational facility, adult entertainment venue, or the like, without departing from the scope of the present invention.

Referring now generally to FIGS. 5-10, an alternative preferred embodiment of the trampoline and pole device 10 is shown in use with a water structure 66. One of ordinary skill in the art would appreciate from this disclosure that the water structure 66 may be a tub, a hot tub, a pool, or the like, without departing from the scope of the present invention. From here on, the water structure 66 may also be referred to as the tub 66. The tub 66 may comprise a tub support structure 68. The tub support structure 68 may support the tub 66 by being positioned on the supporting surface 22. The diameter of the trampoline 12, and the corresponding support/stability structure 14, in this embodiment, must be greater than that of the tub 66 such that the trampoline 12 can fit around the tub 66.

Referring generally now to FIGS. 5 and 6, the pole support structure 34 may comprise a building already positioned over a tub 66. As with previous embodiments, a pole 32 may extend through a hole 30 in the elastic mat 26 of the trampoline 12. The pole 32 may extend up to a stabilizer 44 attached to the building. The pole upper end 108 may optionally be configured with a shower head. The pole lower end 106 extending into the tub 66 may also comprise a vacuum pump. The vacuum pump may be configured to suck water/liquid into the hollow center 58 of the pole 32 and expel the water/liquid out of the shower head located at the pole upper end 108. This expulsion of water/liquid in a shower-like pattern over the trampoline 12 may further get the user of the device wet and increase the entertainment provided.

Referring specifically now to FIG. 6, further structure of the tub 66 may be seen. The tub 66 may comprise a basin 70 contained within the tub support structure 68. The basin 70 may also have a bottom 72 positioned on the supporting surface 22. The basin may be configured to hold a liquid/water 94. A lower pole holder 42 may be attached to the bottom 72 of the tub 66 in order to support the pole 32. The tub 66 may also comprise a rim 74 surrounding an open top 76. The rim 74 may lie just below the generally planar surface 102. The elastic mat 26 may therefore cover the open top 76 of the tub 66. The pole 32 may also be seen extending upward toward the stabilizer 44.

Referring specifically now to FIG. 7, the inside of tub 66 may be seen in greater detail. The lower pole holder 42 may be seen clearly positioned on the bottom 72 of the tub 66. The pole 32 may be seen extending upward from the lower pole holder 42.

Referring specifically now to FIG. 8, the lower pole holder 42 may be seen in greater detail. The lower pole holder 42 may be positioned on the bottom 72 of the tub 66. The lower pole holder 42 may have a conical shape. One of ordinary skill in the art would appreciate from this disclosure that the lower pole holder 42 may comprise any sufficiently strong, supportive, and stabilizing structure so as to support the pole 32 without departing from the scope of the present invention. The lower pole holder 42 may further comprise a lower sleeve 78 contained therein. The lower sleeve 78 may be configured to accommodate the pole lower end 106 of the pole 32.

Referring now to FIGS. 9 and 10, the stabilizer 44 of the retrofit device 10 is shown in greater detail. The stabilizer 44 may comprise an attachment plate 84. A plurality of bolts 80 may be configured to attach the stabilizer 44 to the top supports 48 via the attachment plate 84. By being attached to the top supports 48 of the hole support structure 34, the stabilizer 44 may give support and strength to the pole 32. The stabilizer 44 may further comprise an upper sleeve 82 designed to accommodate a pole upper end 108 of the pole 32. The upper sleeve 82 may be configured to enclose the pole upper end 108 such that the pole 32 may be prevented from tilting off of the pole axis A. One of ordinary skill in the art will appreciate from this disclosure that if the lower pole holder 42 or the stabilizer 44 are sufficiently strong enough to support the pole 32 alone, then the other of the lower pole holder 42 or the stabilizer 44 may be omitted without departing from the scope of the present invention.

Referring now to FIGS. 11 and 12, an alternative preferred stabilizer 44 of the retrofit device 10 is shown in greater detail. The alternative preferred stabilizer 44 may comprise a plurality of U-shaped stabilizers 86. The U-shaped stabilizers 86 may have bolts 80 on the ends of the U in order to affix the U-shaped stabilizers to the top supports 48. The U-shaped stabilizers 86 may form a stabilizer hole 88 to accommodate the pole 32 extending therethrough. At least one U-shaped stabilizer 86 must be employed to support and stabilize the pole 32, but one of ordinary skill in the art would appreciate from this disclosure that any number of U-shaped stabilizers 86 may be used to increase stability of the pole 32 without departing from the scope of the present invention.

Referring now generally to FIGS. 13 and 14, another alternative preferred embodiment of the trampoline and pole device 10 is shown in use with a water structure 66. One of ordinary skill in the art would appreciate that the water structure 66 may be a tub, a hot tub, a pool, or the like, without departing from the scope of the present invention. From here on, the water structure 66 may also be referred to as the tub 66. This embodiment may differ from that of the embodiment disclosed in FIGS. 5-10 in that the rim 74 of the tub 66 may be set at a ground-level. The tub 66 may comprise an inground tub 90. The ground-level may be at the same level as the supporting surface 22. This means that the ground may form the tub support structure 68. The basin 70 of the tub 66 may be entirely set below the ground level. In this embodiment, the generally planar surface 102 may also be at the ground level. In this embodiment, the trampoline 12 may omit the support/stability structure 14. In this way, the outer rim 24 of the trampoline 12 may be connected directly to the rim, or top edge, 74 of the inground tub 90 by an attachment mechanism. The attachment mechanism may connect the plurality of elastic members 54 directly to the rim 74 of the inground tub 90. This means that the trampoline 12 may be entirely supported by the tub 66. This embodiment may also employ the alternative preferred stabilizer 44 featuring the U-shaped stabilizers 86.

Referring specifically to FIG. 13, the elastic mat 26 may comprise a porous material 104. The porous material 104 may allow the liquid/water 94 contained in the tub to penetrate the elastic mat 26 and get a user of the device wet.

Referring specifically to FIG. 14, the pole lower end 106 may be seen set below the ground-level and below the supporting surface 22. This means that the functional base B may be at the supporting surface 22 or below the supporting surface 22. An attachment device may also be employed to attach the Referring now generally to FIGS. 15 and 16, the device/system 10, 100 may be seen in use by a person/user 92. FIG. 15 demonstrates the effect on the elastic mat 26 when a user 92 depresses the elastic mat 26. The elastic mat 26 may reach the maximum concave shape 98. The maximum concave shape 98 may extend below a water surface 96 of the liquid/water 94, but the maximum concave shape 98 will not reach a bottom 72 of the water structure 66. As can be seen clearly in the figure, the feet of the person/user 92 can be seen extending into the liquid/water 94. This has the effect of the person/user 92 getting wet. The porous material 104 of the elastic mat 26 may increase the effect of the person/user 92 getting wet.

Referring specifically to FIG. 16, the trampoline effect of the trampoline 12 can be seen bouncing the person/user upwards. A returning force F may propel the user 92 further up the pole 32 to reach heights otherwise unattainable by climbing alone. The returning force F may also have the effect of flinging or splashing the liquid/water 94 onto the user/person 92. The liquid/water 94 may be configured with a lower density liquid floating on the water surface 96. The effect of the lower density liquid may be that repeated bouncing by the user 92 results in the production of bubbles being dispersed throughout. The bouncing effect that is achieved by the user/person 92 engaging with the elastic mat 26 may be repeated as desired. The returning force F may also allow the person/user to lift off of the elastic, or jumping, mat 26.

One advantage of the combination trampoline and pole device 10 and/or the entertainment system 100 may be to provide lift assistance to a user/person 92 in climbing and/or reaching new heights on the pole 32. A further advantage of the device/system 10, 100 may be to provide additional cushioning should the user/person 92 slide down or fall off the pole 32.

Another advantage of the trampoline and pole retrofit device 10 is that it may be used with an already existing water structure 66 such as a hot tub. This may provide further entertainment and enjoyment as the user/person 92 is no longer limited to just using a trampoline and/or a pole, but may also be able to dunk into and splash around in the water/liquid 94 contained in the tub 66.

One of ordinary skill in the art will appreciate from this disclosure that the various components and elements of the present invention may be constructed of any suitably strong, wear-resistant, flexible (where desired), and inexpensive metals, polymers, alloys, plastics, fabrics, and other materials without departing from the scope of the present invention.

One of ordinary skill in the art will appreciate from this disclosure that device elements, as well as materials, shapes and dimensions of device elements, as well as methods other than those specifically exemplified can be employed in the practice of the invention without resort to undue experimentation. All art-known functional equivalents, of any such materials and methods are intended to be included in this invention. The terms and expressions which have been employed are used as terms of description and not of limitation, and there is no intention that in the use of such terms and expressions of excluding any equivalents of the features shown and described or portions thereof, but it is recognized that various modifications are possible within the scope of the invention claimed, described in the specification, and/or shown in the figures. Thus, it should be understood that although the present invention has been specifically disclosed by preferred embodiments and optional features, modification and variation of the concepts herein disclosed may be resorted to by those skilled in the art, and that such modifications and variations are considered to be within the scope of this invention.

What is claimed is:

1. A combination trampoline and pole device, comprising:
- a trampoline, comprising:
  - a support structure having an open top side;
  - an elastic mat configured to at least partially cover the open top side of the support structure; and
  - a plurality of elastic members configured to connect the elastic mat to the support structure; and
- a pole configured to extend through a hole in the elastic mat such that the pole is substantially perpendicular to the elastic mat when unstretched.

2. The device of claim 1, wherein the support structure and the pole extend from a supporting surface.

3. The device of claim 2, wherein the open top side of the support structure extends to a first height above the supporting surface.

4. The device of claim 3, wherein when the elastic mat and the elastic members are fully stretched under the weight of a user, the elastic mat forms a maximum concave shape, the maximum concave shape having a second height which is less than the first height.

5. The device of claim 4, wherein the pole remains centered in the hole when the elastic mat is stretched.

6. The device of claim 5, wherein the elastic mat and elastic members provide a returning force to propel and assist the user in climbing the pole.

7. The device of claim 6, the support structure further comprising a basin, the basin being located between the elastic mat and the supporting surface, the basin being capable of containing liquid.

8. The device of claim 5, wherein the hole is configured with a grommet, the grommet having a diameter large enough to accommodate the pole, the grommet reducing wear and friction on the hole and the pole when the trampoline is in use.

9. The device of claim 2, wherein the support structure, the trampoline, and the pole are detachably affixed to the supporting surface.

10. A retrofit trampoline and pole device for use with a water structure having an open top, comprising:
- an elastic mat configured to at least partially cover the open top of the water structure;
- a plurality of elastic members configured to stretch the elastic mat over the water structure;
- an attachment mechanism for connecting the plurality of elastic members to a top edge of the water structure; and
- a pole configured to extend through a hole in the elastic mat such that the pole is substantially perpendicular to the elastic mat when unstretched.

11. The device of claim 10, wherein when the elastic mat and the elastic members are fully stretched under the weight of a user, the elastic mat forms a maximum concave shape, the maximum concave shape being under a surface of water in the water structure and above a bottom of the water structure.

12. The device of claim 11, wherein the elastic mat is porous and allows the water to penetrate the elastic mat so that the user gets wet when the elastic mat is stretched below the surface of the water.

13. The device of claim 12, wherein a lower end of the pole is detachably connected the bottom of the water structure.

14. The device of claim 11, wherein the elastic mat may be is set at a ground level when the top edge of the water structure is set at the ground level and a remaining portion of the water structure is beneath the ground level.

15. An entertainment system configured for use by a person positionable on and generally supportable along a generally planar surface, comprising:
- a pole configured to extend generally upwardly from the generally planar surface, the pole having a functional base positioned along the generally planar surface;
- a jumping mat positioned on the generally planar surface and extending outwardly from the functional base of the pole, wherein the jumping mat is configured to provide a trampoline effect; and
- wherein the pole is fixable in position to allow the person to interact therewith and lift off of the jumping mat such that by partially disengaging from the pole the person can then at least one of the group of bounce on the jumping mat and depress the jumping mat;
- a stability structure, the stability structure having a stabilizer configured to accommodate an upper end of the pole;
- a mirrored ball positioned on the stabilizer and configured to rotate; and
- a plurality of lights positioned at predetermined points on the stability structure, the plurality of lights comprising a plurality of colors,
- at least one of the plurality of lights shining generally downwardly toward the person and at least another of the plurality lights shining toward the mirrored ball.

16. The entertainment system of claim 15, wherein the plurality of lights are configured to move, change colors, and flash in response to the person bouncing on the mat and music playing during use.

17. An entertainment system configured for use by a person positionable on and generally supportable along a generally planar surface, comprising:

a pole configured to extend generally upwardly from the generally planar surface, the pole having a functional base positioned along the generally planar surface;

a jumping mat positioned on the generally planar surface and extending outwardly from the functional base of the pole, wherein the jumping mat is configured to provide a trampoline effect; and wherein the pole is fixable in position to allow the person to interact therewith and lift off of the jumping mat such that by partially disengaging from the pole the person can then at least one of the group of bounce on the jumping mat and depress the jumping mat; and wherein the jumping mat has a central hole, the central hole being configured to accommodate the pole extending therethrough.

18. The entertainment system of claim 17, further comprising a stability structure, the stability structure having a stabilizer configured to accommodate an upper end of the pole.

19. The entertainment system of claim 17, wherein the jumping mat is detachably positioned over a water structure so that when the person depresses the mat, the person can get wet from the water contained in the water structure.

* * * * *